US010801266B2

(12) United States Patent
Ricks et al.

(10) Patent No.: US 10,801,266 B2
(45) Date of Patent: Oct. 13, 2020

(54) EARTH-BORING TOOLS HAVING FIXED BLADES AND ROTATABLE CUTTING STRUCTURES AND RELATED METHODS

(71) Applicant: Baker Hughes, a GE company, LLC, Houston, TX (US)

(72) Inventors: Gregory L. Ricks, Spring, TX (US); Mitchell A. Rothe, Montgomery, TX (US); Floyd C. Felderhoff, Montgomery, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 119 days.

(21) Appl. No.: 15/983,639

(22) Filed: May 18, 2018

(65) Prior Publication Data

US 2019/0352970 A1 Nov. 21, 2019

(51) Int. Cl.

| | |
|---|---|
| ***E21B 10/14*** | (2006.01) |
| ***E21B 10/62*** | (2006.01) |
| *E21B 10/567* | (2006.01) |

(52) U.S. Cl.

CPC ..... *E21B 10/14* (2013.01); *E21B 10/62* (2013.01); *E21B 10/567* (2013.01)

(58) Field of Classification Search

CPC ..... E21B 10/14; E21B 10/22; E21B 10/18; E21B 10/567; E21B 10/62

See application file for complete search history.

(56) References Cited

U.S. PATENT DOCUMENTS 2,055,145 A * 9/1936 Christian ..... E21B 10/42 175/393

6,241,034 B1 6/2001 Steinke et al.

(Continued)

FOREIGN PATENT DOCUMENTS

EP 1071055 A1 1/2001

JP 2002-149824 A 5/2002

(Continued)

OTHER PUBLICATIONS

Atallah et al., Behaviour Profiling with Ambient and Wearable Sensing, Proceedings of the International Workshop on Wearable and Implantable Body Sensor Networks, (Mar. 26, 2007), pp. 133-138.

(Continued)

*Primary Examiner* — Michael R Wills, III

(74) *Attorney, Agent, or Firm* — TraskBritt

(57) ABSTRACT

An earth-boring tool includes a body, at least one blade, and at least one rotatable cutting structure. The blade extends axially from the body and extends radially outward from a center longitudinal axis of the earth-boring tool to less than an outer diameter of the earth-boring tool. The blade defines a first cutting profile. The at least one rotatable cutting structure assembly is coupled to the body and includes a leg extending axially from the body and a rotatable cutting structure rotatably coupled to the leg. The rotatable cutting structure defines a second cutting profile extending to the outer diameter of the earth-boring tool. The first cutting profile overlaps with the second cutting profile in a radial direction in an amount that is less than 20% of the outer diameter of the earth-boring tool. A method of making an earth-boring tool.

18 Claims, 8 Drawing Sheets

(56) References Cited

U.S. PATENT DOCUMENTS

| | | | | |
|---|---|---|---|---|
| 6,345,673 | B1 | 2/2002 | Siracki | |
| 6,510,909 | B2 | 1/2003 | Portwood et al. | |
| 6,561,291 | B2 | 5/2003 | Xiang | |
| 6,823,951 | B2 | 11/2004 | Yong et al. | |
| 7,621,345 | B2 | 11/2009 | Cepeda et al. | |
| 7,677,333 | B2 | 3/2010 | Mensa-Wilmot | |
| 8,672,060 | B2 | 3/2014 | Centala et al. | |
| 9,033,069 | B2 | 5/2015 | Zhang | |
| 9,476,259 | B2 * | 10/2016 | Ricks | E21B 10/14 |
| 9,587,438 | B2 | 3/2017 | Chen | |
| 9,644,429 | B2 | 5/2017 | Mensa-Wilmot | |
| 9,903,162 | B2 | 2/2018 | Siracki et al. | |
| 2008/0021731 | A1 | 1/2008 | Rodgers | |
| 2008/0264695 | A1 | 10/2008 | Zahradnik et al. | |
| 2009/0166093 | A1 | 7/2009 | Pessier et al. | |
| 2010/0018777 | A1 | 1/2010 | Pessier et al. | |
| 2010/0116556 | A1 | 5/2010 | Buske | |
| 2011/0079441 | A1 | 4/2011 | Buske et al. | |
| 2011/0079444 | A1 | 4/2011 | Kulkarni | |
| 2011/0162893 | A1 | 7/2011 | Zhang | |
| 2013/0313021 | A1 | 11/2013 | Zahradnik et al. | |
| 2016/0108680 | A1 | 4/2016 | Rothe | |
| 2016/0348440 | A1 | 12/2016 | Gan et al. | |
| 2017/0058609 | A1 | 3/2017 | Chen et al. | |
| 2017/0167201 | A1 | 6/2017 | Clausen | |
| 2018/0355670 | A1 * | 12/2018 | Stroever | E21B 29/00 |
| 2019/0063159 | A1 | 2/2019 | Schoen | |

FOREIGN PATENT DOCUMENTS

| | | | |
|---|---|---|---|
| JP | 2004-164282 | A | 6/2004 |
| JP | 2016-136293 | A | 7/2016 |
| WO | 2003/102865 | A1 | 12/2003 |

OTHER PUBLICATIONS

International Search Report for International Application No. PCT/US2019/032850 dated Aug. 29, 2019, 4 pages.

International Written Opinion for International Application No. PCT/US2019/032850 dated Aug. 29, 2019, 5 pages.

* cited by examiner

EARTH-BORING TOOLS HAVING FIXED BLADES AND ROTATABLE CUTTING STRUCTURES AND RELATED METHODS

TECHNICAL FIELD

This disclosure relates generally to earth-boring tools having fixed blades, fixed cutting elements, and rotatable cutting structures.

BACKGROUND

Oil wells (wellbores) are usually drilled with a drill string. The drill string includes a tubular member having a drilling assembly that includes a single drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and/or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore.

BRIEF SUMMARY

Some embodiments of the present disclosure include earth-boring tools. The earth-boring tools may include a body, at least one blade, and at least one rotatable cutting structure. The at least one blade may extend axially from the body and may extend radially outward from a center longitudinal axis of the earth-boring tool to less than an outer diameter of the earth-boring tool. The at least one blade may define a first cutting profile. The at least one rotatable cutting structure assembly may be coupled to the body and may include a leg extending axially from the body and a rotatable cutting structure rotatably coupled to the leg. The rotatable cutting structure may define a second cutting profile extending to the outer diameter of the earth-boring tool. The first cutting profile may overlap with the second cutting profile in a radial direction in an amount that is less than 10% of the outer diameter of the earth-boring tool.

In additional embodiments, the earth-boring tool may include a body, a blade structure, and a plurality of rotatable cutting structure assemblies. The blade structure may include a plurality of blades extending axially from the body, and each blade may extend radially outward from proximate a center longitudinal axis of the earth-boring tool to less than an outer diameter of the earth-boring tool. The plurality of blades may define a first cutting profile. The plurality of rotatable cutting structure assemblies may be coupled to the body, and each rotatable cutting structure assembly may include a leg extending axially from the body and a rotatable cutting structure rotatably coupled to the leg. The rotatable cutting structures of the plurality of rotatable cutting structure assemblies may define a second cutting profile extending to the outer diameter of the earth-boring tool, and the first cutting profile may overlap with the second cutting profile in a radial direction in an amount that is less than 10% of the outer diameter of the earth-boring tool.

Some embodiments of the present disclosure include a method of forming an earth-boring tool. The method may include forming a body having at least one blade extending axially from the body and extending radially outward from a center longitudinal axis of the earth-boring tool to less than an outer diameter of the earth-boring tool, the at least one blade defining a first cutting profile; coupling at least one rotatable cutting structure assembly to the body, the at least one rotatable cutting structure assembly including: a leg extending axially from the body; and a rotatable cutting structure rotatably coupled to the leg, the rotatable cutting structure defining a second cutting profile extending to the outer diameter of the earth-boring tool, wherein coupling the at least one rotatable cutting structure assembly to the body comprises, coupling the rotatable cutting structure rotatably to the leg such that the first cutting profile overlaps with the second cutting profile in a radial direction in an amount that is less than 10% of the outer diameter of the earth-boring tool.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
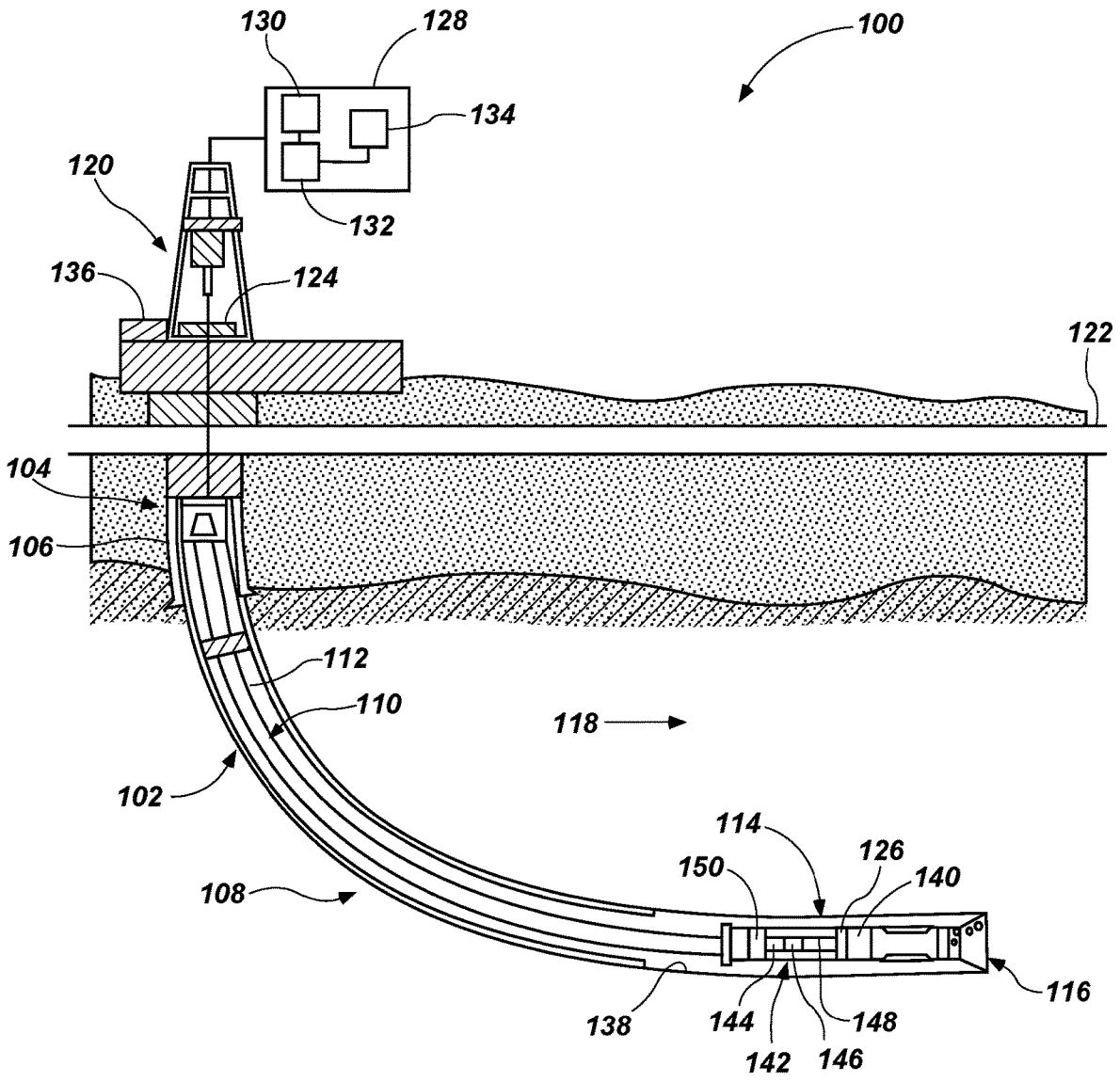
FIG. 1 is a schematic diagram of a wellbore system comprising a drill string that includes an earth-boring tool according to one or more embodiments of the present disclosure.

The illustrations presented herein are not actual views of any drill bit, roller cutter, or any component thereof, but are merely idealized representations, which are employed to describe the present invention.

As used herein, the terms "bit" and "earth-boring tool" each mean and include earth-boring tools for forming, enlarging, or forming and enlarging a borehole. Non-limiting examples of bits include fixed-cutter ("drag") bits, fixed-cutter coring bits, fixed-cutter eccentric bits, fixed-cutter bi-center bits, fixed-cutter reamers, expandable reamers with blades bearing fixed cutters, and hybrid bits including both fixed cutters and rotatable cutting structures (roller cones).

As used herein, the term "cutting structure" means and includes any element that is configured for use on an earth-boring tool and for removing formation material from the formation within a wellbore during operation of the earth-boring tool. As non-limiting examples, cutting structures include rotatable cutting structures, commonly referred to in the art as "roller cones" or "rolling cones."

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to rotatable cutting structures, such as roller cones. Additionally, in regard to rotatable cutting structures, the term "cutting elements" includes both milled teeth and/or PDC cutting elements. Moreover, the term "cutting elements" includes tungsten carbide inserts.

As used herein, any relational term, such as "first," "second," "top," "bottom," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Some embodiments of the present disclosure include a hybrid earth-boring tool having both blades and rotatable cutting structures. In particular, the earth-boring tool may include a PDC cutting profile (e.g., a cutting profile defined by cutting elements of fixed blades of the earth-boring tool) extending across a portion of a diameter of the earth-boring tool. For instance, the PDC cutting profile may extend radially outward from a center of the earth-boring tool and may extend so as to cover between about 25% and about 50% of the earth-boring tool outer diameter. The rotatable cutting structures (e.g., roller cones) may form (e.g., define) a remainder of the cutting profile of the earth-boring tool. For example, a cutting profile defined by the rotatable cutting structures may extend from (e.g., define) the outer diameter of the earth-boring tool and may extend radially inward to the PDC cutting profile of the fixed blades. In some embodiments, the cutting profile defined by the rotatable cutting structures and the PDC cutting profile may overlap in an amount that is about 20%, 10%, 5% or less of the outer diameter of the earth-boring tool.

In one or more embodiments, either of the PDC cutting profile or the cutting profile defined by the rotatable cutting structures may be recessed relative to the other in an axial direction. In comparison to conventional hybrid earth-boring tools, the earth-boring tool of the present disclosure may have rotatable cutting structures having larger diameters and higher offsets.

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disc. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank 208 and/or crown 210 of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2:
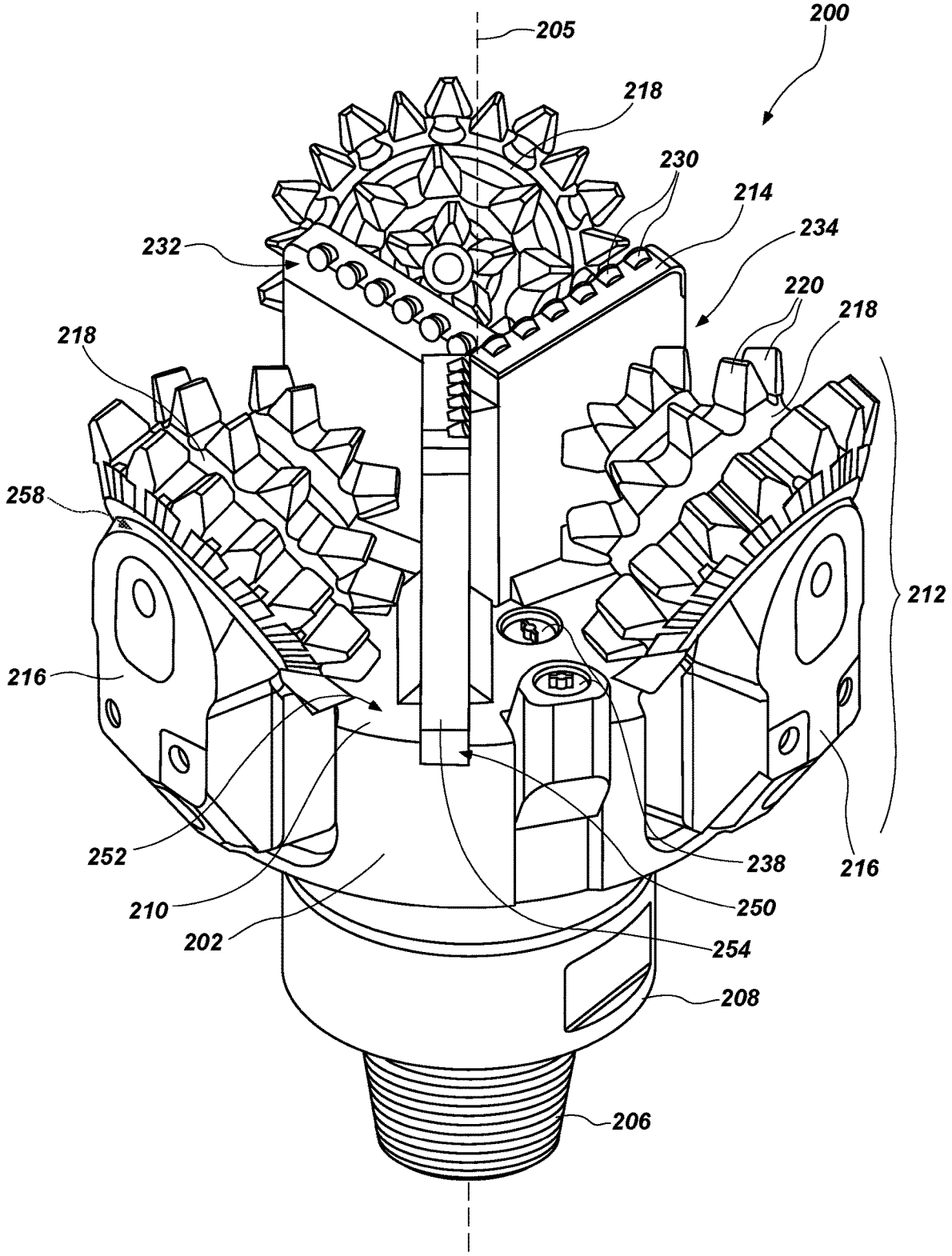
FIG. 2 is a top perspective view of an earth-boring tool according to one or more embodiments of the present disclosure.
Figure 3:
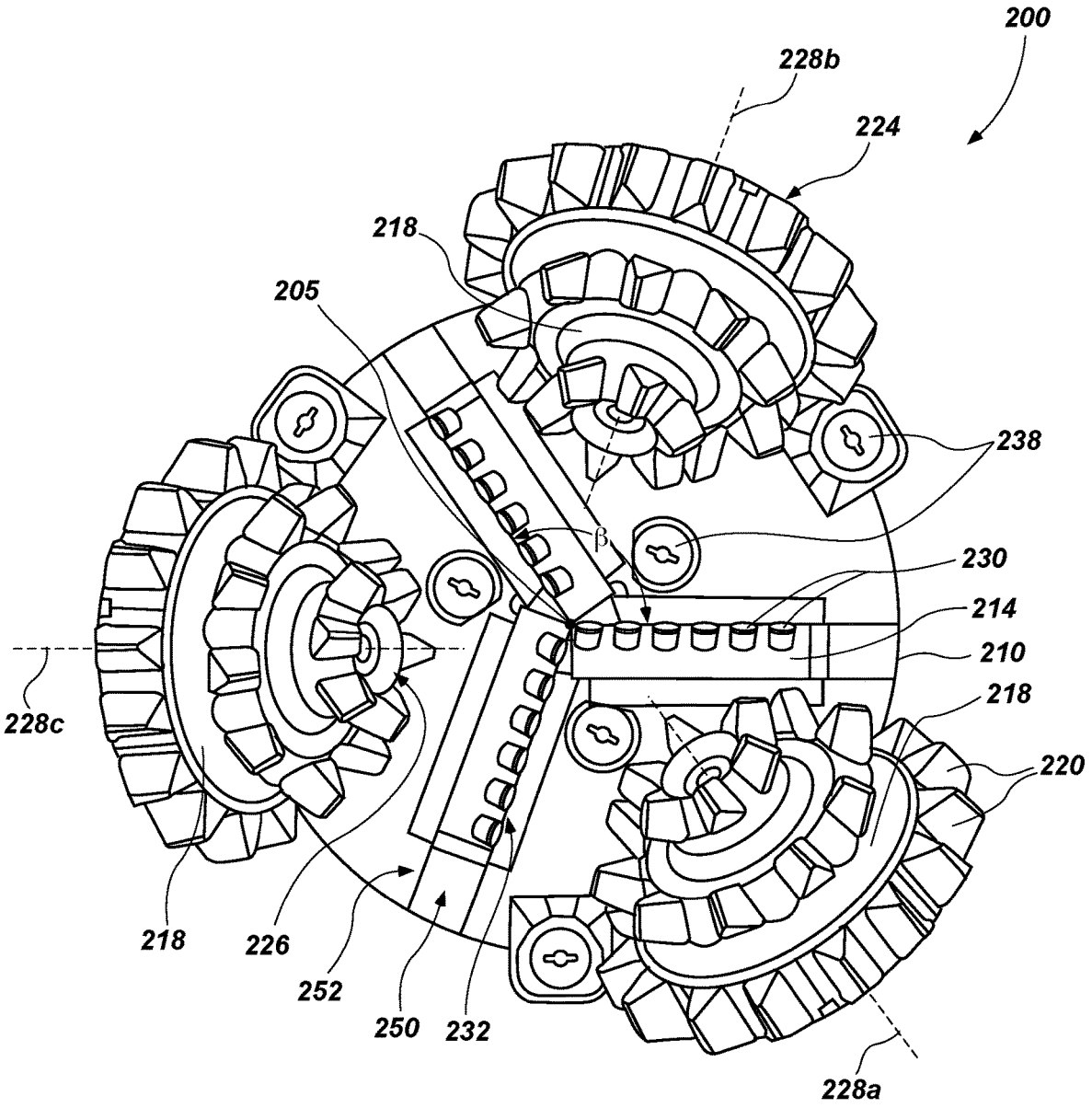
FIG. 3 is a top view of an earth-boring tool according to one or more embodiments of the present disclosure.

FIG. 2 is a perspective view of an earth-boring tool 200 that may be used with the drilling assembly 114 of FIG. 1 according to one or more embodiments of the present disclosure. FIG. 3 is a top view of the earth-boring tool 200 of FIG. 2. Referring to FIGS. 2 and 3 together, the earth-boring tool 200 may include a drill bit having one or more rotatable cutting structures 218 in the form of roller cones and one or more blades 214. For example, the earth-boring tool 200 may be a hybrid bit (e.g., a drill bit having both roller cones and blades) as shown in FIGS. 2 and 3.

The earth-boring tool 200 may comprise a body 202 including a neck 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center defining a center longitudinal axis 205 that may generally coincide with a rotational axis of the earth-boring tool 200. The center longitudinal axis 205 of the body 202 may extend in a direction hereinafter referred to as an "axial direction."

The body 202 may be connectable to a drill string 110 (FIG. 1). For example, the neck 206 of the body 202 may have a tapered upper end having threads thereon for connecting the earth-boring tool 200 to a box end of a drilling assembly 114 (FIG. 1). The shank 208 may include a lower straight section that is fixedly connected to the crown 210 at a joint. In some embodiments, the crown 210 may include a plurality of rotatable cutting structure assemblies 212 and a plurality of blades 214.

Each blade 214 of the plurality of blades 214 of the earth-boring tool 200 may include a plurality of cutting elements 230 fixed thereto. The plurality of cutting elements 230 of each blade 214 may be located in a row along a profile of the blade 214 proximate a rotationally leading face 232 of the blade 214. Additionally, each of the rotatable cutting structure assemblies 212 may include a rotatable cutting structure 218 having a plurality of cutting elements 220 (e.g., teeth or tungsten carbide inserts). In some embodiments, the plurality of cutting elements 220 of the plurality of rotatable cutting structures 218 (e.g., roller cutters) and the plurality of cutting elements 230 of the plurality of blades 214 may include PDC cutting elements. Moreover, the plurality of cutting elements 230 of the plurality of rotatable cutting structures 218 and the plurality of cutting elements 230 of the plurality of blades 214 may include any suitable cutting element configurations and materials for drilling and/or enlarging boreholes. For instance, in some embodiments, the plurality of cutting elements 220 may include carbide cylinders, hardfaced blocks, or any other superhard elements known in the art. The cutting elements 220 of the rotatable cutting structures 218 are described in greater detail below.

In some embodiments, the plurality of blades 214 may be separate and distinct from the body 202 of the earth-boring tool 200. For example, the plurality of blades 214 may be removably attached to the body 202 of the earth-boring tool 200. Furthermore, each of the blades 214 of the plurality of blades 214 may be separate and distinct from each other. In one or more embodiments, the body 202 may have a plurality of key apertures and/or recesses 250 formed therein (e.g., extending axially into the body 202 from a lower surface 252 of the body 202), and each blade 214 of the plurality of blades 214 may have a correlating key member 254 sized and shaped to be inserted (e.g., insertable) into a respective key aperture 250 of the plurality of key apertures 250. Accordingly, the plurality of blades 214 may be secured to the body 202 by inserting the key members 254 of the plurality of blades 214 into the key apertures 250 of the body 202. In additional embodiments, the plurality of blades 214 may be attached via other fasteners such as, for example, splined lug nuts. Furthermore, the plurality of blades 214 may be welded to the body 202 in addition to or alternatively to the plurality of key members 254.

In one or more embodiments, the plurality of blades 214 may each form a part of a single blade structure. In other words, the plurality of blades 214 may be connected together within the single blade structure. Furthermore, the single blade structure may include one or more key members 254 correlating to one or more key apertures 250 of the body 202 of the earth-boring tool 200. In yet other embodiments, the plurality of blades 214 and the body 202 of the earth-boring tool 200 may be portions of an integral, unitary body.

In some embodiments, each blade 214 of the plurality of blades 214 may extend radially outward from the center longitudinal axis 205 of the earth-boring tool 200. Furthermore, each blade 214 of the plurality of blades 214 may extend radially outward to less than an outer diameter of the earth-boring tool 200. In other words, each blade 214 of the plurality of blades 214 may extend radially outward a distance that is less than a radius of the earth-boring tool 200. For instance, each blade 214 of the plurality of blades 214 may extend radially outward from the center longitudinal axis 205 of the earth-boring tool 200 a distance that is between about 12% and about 25% of the overall diameter the earth-boring tool 200. As is discussed in greater detail in regard to FIG. 5, the plurality of blades 214 may define a first cutting profile of the earth-boring tool 200. As used herein, the term "cutting profile" may refer to a profile or outline of cutting elements as the cutting elements 230 would appear in a rotated view, i.e., when the earth-boring tool 200 is rotated about its center longitudinal axis 205.

In one or more embodiments, the plurality of blades 214 may be angularly spaced apart from one another. For example, a leading face of a first blade of the plurality of blades 214 may be angularly spaced apart from a leading face of a second adjacent blade by an angle β. In one or more embodiments, the angle β may be within a range extending from about 70° to about 125°. For example, in one or more embodiments, angle β may be about 90°. For instance, when the plurality of blades 214 includes four blades, angle β may be about 90°. In other embodiments, angle β may be about 120°. For instance, when the plurality of blades 214 includes three blades, angle β may be about 120°. In some embodiments, the angle β may vary between blades such that not all angles between blades are equal. For example, when the plurality of blades 214 includes three blades, angles β could be about 115°, 120°, and 125°.

Additionally, in some embodiments, each blade 214 of the plurality of blades 214 may have an at least substantially uniform cross-section when viewed from a plane orthogonal to the center longitudinal axis 205 of the earth-boring tool 200. Put another way, the blade 214 may not substantially change shape as it extends axially (i.e., in the axial direction) from the body 202 of the earth-boring tool 200.

Fluid courses 234 may be formed between adjacent blades 214 of the plurality of blades 214 and may be provided with drilling fluid by ports located at the end of passages leading from an internal fluid plenum extending through the body 202 from a tubular shank 208 at the upper end of the earth-boring tool 200. Nozzles 238 may be secured within the ports for enhancing direction of fluid flow and controlling flow rate of the drilling fluid. In some embodiments, one or more nozzles 238 may be oriented proximate to an outer periphery of the body 202 of the earth-boring tool 200. In some embodiments, the fluid courses 234 extend to junk slots extending axially along the longitudinal side of earth-boring tool 200 between blades 214 of the plurality of blades 214.

The plurality of rotatable cutting structure assemblies 212 may include a plurality of legs 216 and the plurality of rotatable cutting structures 218, each respectively mounted to a leg 216. The plurality of legs 216 may extend from an end of the body 202 opposite the neck 206 and may extend in the axial direction. Additionally, in some embodiments, the plurality of legs 216 may extend outward radially from the body 202. As a result, the legs 216 and/or the rotatable cutting structures 218 of the plurality of rotatable cutting structure assemblies 212 may define the outer diameter of the earth-boring tool 200. In some embodiments, each leg 216 of the plurality of legs 216 may define a mounting surface 258 for a respective rotatable cutting structure 218 at a distal end thereof (e.g., an end of the leg 216 opposite the body 202). Each rotatable cutting structure 218 may be rotatably mounted to a respective leg 216 of the body 202 at the mounting surface 258. For example, each rotatable cutting structure 218 may be mounted to a respective leg 216 with one or more of a journal bearing and rolling-element bearing. Many such bearing systems are known in the art and may be employed in embodiments of the present disclosure. In one or more embodiments, the mounting surface 258 of each leg 216 of the plurality of legs 216 may at least generally face the center longitudinal axis 205 of the earth-boring tool 200.

Each rotatable cutting structure 218 of the plurality of rotatable cutting structures 218 may have a rotational axis 228*a*, 228*b*, 228*c* about which each rotatable cutting structure 218 may rotate during use of the earth-boring tool 200 in a drilling operation. In some embodiments, the rotational axis 228*a*, 228*b*, 228*c* of each rotatable cutting structure 218 of the plurality of rotatable cutting structures 218 may intersect the center longitudinal axis 205 of the earth-boring tool 200. In other embodiments, the rotational axis 228*a*, 228*b*, 228*c* of one or more rotatable cutting structures 218 of the plurality of rotatable cutting structures 218 may be offset from the center longitudinal axis 205 of the earth-boring tool 200. For example, the rotational axis 228*a*, 228*b*, 228*c* of one or more rotatable cutting structures 218 of the plurality of rotatable cutting structures 218 may be laterally offset (e.g., angularly skewed) such that the rotational axis 228*a*, 228*b*, 228*c* of the one of more rotatable cutting structures 218 of the plurality of rotatable cutting structures 218 does not intersect the center longitudinal axis 205 of the earth-boring tool 200. In some embodiments, a ratio of a linear offset and the outer diameter of the earth-boring tool 200 may be within a range extending from about 0.024 to about 0.028. In some embodiments, one or more rotatable cutting structures 218 of the plurality of rotatable cutting structure assemblies 212 may have a linear offset of about 0.375 inch, about 0.438 inch, 0.500 inch, 0.594 inch, or greater than 0.688 inch depending on an outer diameter of the earth-boring tool 200. For instance, if the earth-boring tool 200 has an outer diameter of 26.0 inches, the rotatable cutting structure assemblies 212 may have a linear offset of about 0.688 inch. As will be appreciated by one of ordinary skill in the art, the foregoing values of offsets are atypical in regard to typical hybrid bits as typical hybrid bits have offset values less than about 0.250 inch.

Additionally, as noted above, each rotatable cutting structure 218 may have the plurality of cutting elements 220 thereon. In some embodiments, the plurality of cutting elements 220 of each rotatable cutting structure 218 may be arranged in generally circumferential rows on an outer surface of the rotatable cutting structure 218. In other embodiments, the cutting elements 220 may be arranged in an at least substantially random configuration on the outer surface of the rotatable cutting structure 218. In some embodiments, the cutting elements 220 of the rotatable cutting structure 218 may be in the form of teeth integrally formed with the material of each rotatable cutting structure 218. In other words, the rotatable cutting structures 218 may include steel milled-tooth rotatable cutting structures, as known in the art. Additionally, as is known in the art, the teeth may be coated (e.g., plated) with one or more hard-facing materials. In other embodiments, the cutting elements 220 may comprise preformed inserts that are interference fitted into apertures formed in each rotatable cutting structure 218. The cutting elements 220, if in the form of inserts, may be formed from tungsten carbide, and optionally have a distal surface of polycrystalline diamond, cubic boron nitride, or any other wear-resistant and/or abrasive or superabrasive material. As will be understood by one of ordinary skill in the art, having the rotatable cutting structures 218 include steel milled-tooth rotatable cutting structures 218 may enable more aggressive drilling procedures in comparison to fixed-cutter PDC bits, which would ball excessively, so called "gumbo" shales. Additionally, tungsten carbide insert cutting structures would tend to be too slow in these formations.

Figure 5:
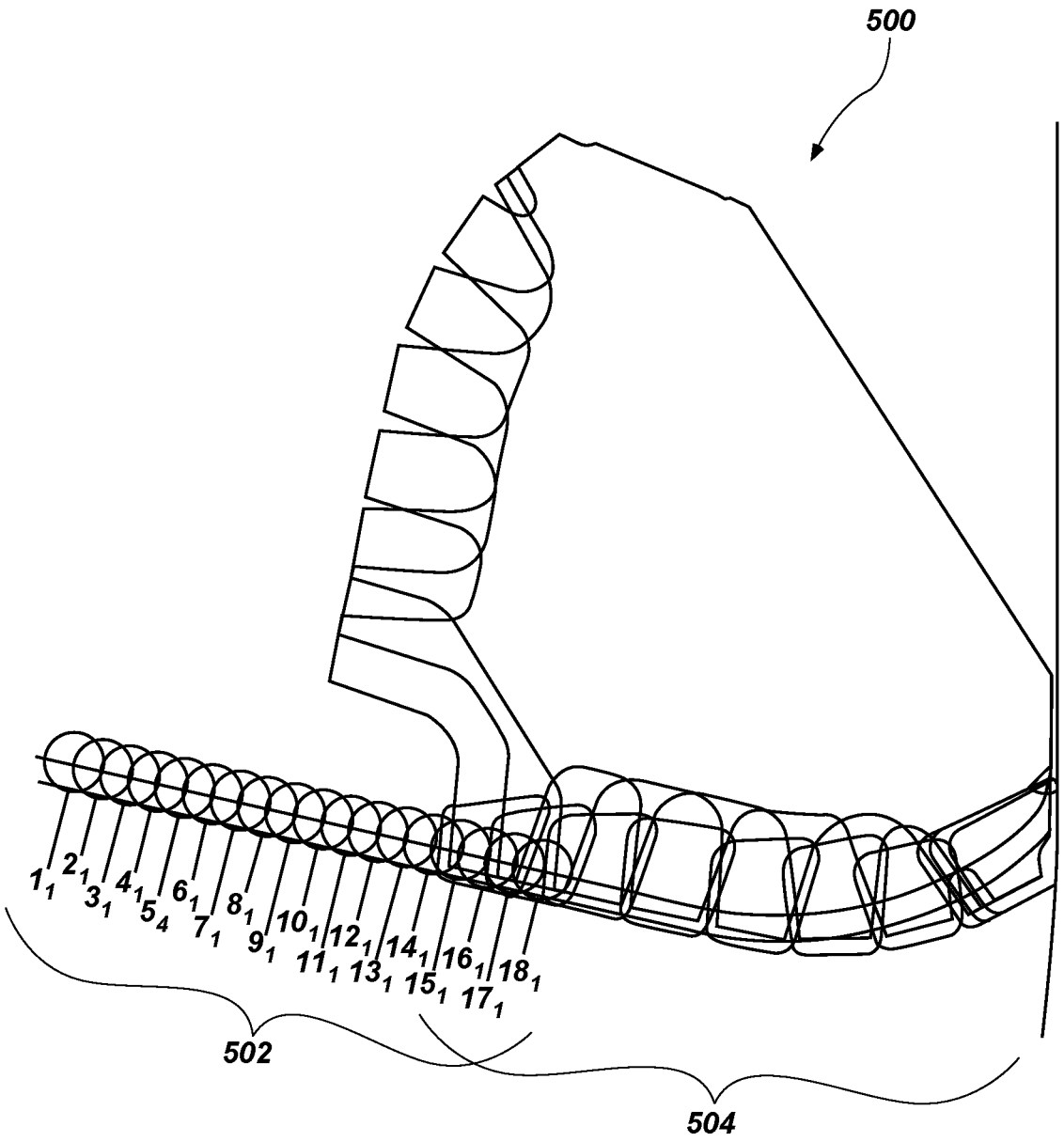
FIG. 5 is a schematic-cross-sectional view of a cutting profile of an earth-boring tool according to an embodiment of the present disclosure.

The rotatable cutting structures 218 of the plurality of rotatable cutting structure assemblies 212 may define a second cutting profile of the earth-boring tool 200, and as is discussed in greater detail in regard to FIG. 5, the first and second cutting profiles of the earth-boring tool 200 tool may overlap a relatively small amount. Additionally, the second cutting profile defined by the rotatable cutting structures 218 may extend to the outer diameter of the earth-boring tool 200.

In some embodiments, each rotatable cutting structure 218 of the plurality of rotatable cutting structures 218 may have a general conical shape, with a base end 224 (e.g., wide end and radially outermost end 224) of the conical shape being mounted to a respective leg 216 and a tapered end 226 (e.g., radially innermost end 226) being proximate (e.g., at least substantially pointed toward) the center longitudinal axis 205 of the body 202 of the earth-boring tool 200. In other embodiments, each rotatable cutting structure 218 of the plurality of rotatable cutting structures 218 may not have a generally conical shape but may have any shape appropriate for rotatable cutting structures 218. In some embodiments, the radially innermost end 226 of each rotatable cutting structure 218 of the plurality of rotatable cutting structures 218 may be radially spaced from the center longitudinal axis 205 of the earth-boring tool 200. As is discussed in greater detail below in regard to FIG. 5, the radially innermost end 226 of each rotatable cutting structure 218 of the plurality of rotatable cutting structures 218 may be radially spaced from the center longitudinal axis 205 roughly a same amount as radially outermost edges of the plurality of blades 214. For example, as noted above, the first cutting profile of the plurality of blades 214 may overlap with the second cutting profile of the rotatable cutting structures 218 a relatively small amount.

In some embodiments, the plurality of rotatable cutting structures 218 may be angularly spaced apart from each other around the center longitudinal axis 205 of the earth-boring tool 200. For example, a first rotational axis 228*a* of a first rotatable cutting structure 218*a* (FIG. 4) of the plurality of rotatable cutting structures 218 may be circumferentially angularly spaced apart from a second rotational axis 228*b* of a second rotatable cutting structure 218*b* (FIG. 4) by about 75° to about 180°. In some embodiments, the rotatable cutting structures 218 may be angularly spaced apart from one another by an acute angle. For example, in some embodiments, the rotatable cutting structures 218 may be angularly spaced apart from one another by about 120°. In other embodiments, the rotatable cutting structures 218 may be angularly spaced apart from one another by about 150°. In other embodiments, the rotatable cutting structures 218 may be angularly spaced apart from one another by about 180°. Although specific degrees of separation of rotational axes (i.e., number of degrees) are disclosed herein, one of ordinary skill in the art would recognize that the rotatable cutting structures 218 may be angularly spaced apart from one another by any suitable amount.

In some embodiments, each rotatable cutting structure 218 of the plurality of rotatable cutting structures 218 may be disposed between two adjacent blades of the plurality of blades 214. Furthermore, the radially innermost end 226 of each rotatable cutting structure 218 may generally extend toward (e.g., point toward) an interface of the two adjacent blades proximate the center longitudinal axis 205 of the earth-boring tool 200. In some embodiments, a rotatable cutting structure 218 of the plurality of rotatable cutting structures 218 may be more proximate (e.g., closer to) one blade of the two adjacent blades between which the rotatable cutting structure 218 is disposed. In other words, the rotatable cutting structure 218 of the plurality of rotatable cutting structures 218 may not be centered between the two adjacent blades between which the rotatable cutting structure 218 is disposed. In other embodiments, the rotatable cutting structure 218 of the plurality of rotatable cutting structures 218 may be centered between the two adjacent blades between which the rotatable cutting structure 218 is disposed. Referring still to FIGS. 2 and 3 together, in some embodiments, the earth-boring tool 200 may include saddle mounted cutters in addition to or in place of the plurality of rotatable cutting structure assemblies 212. Moreover, the earth-boring tool 200 may further include any pilot bits and/or similar nested bit structures known in the art in addition to or in place of the plurality of blades 214.

Figure 4:
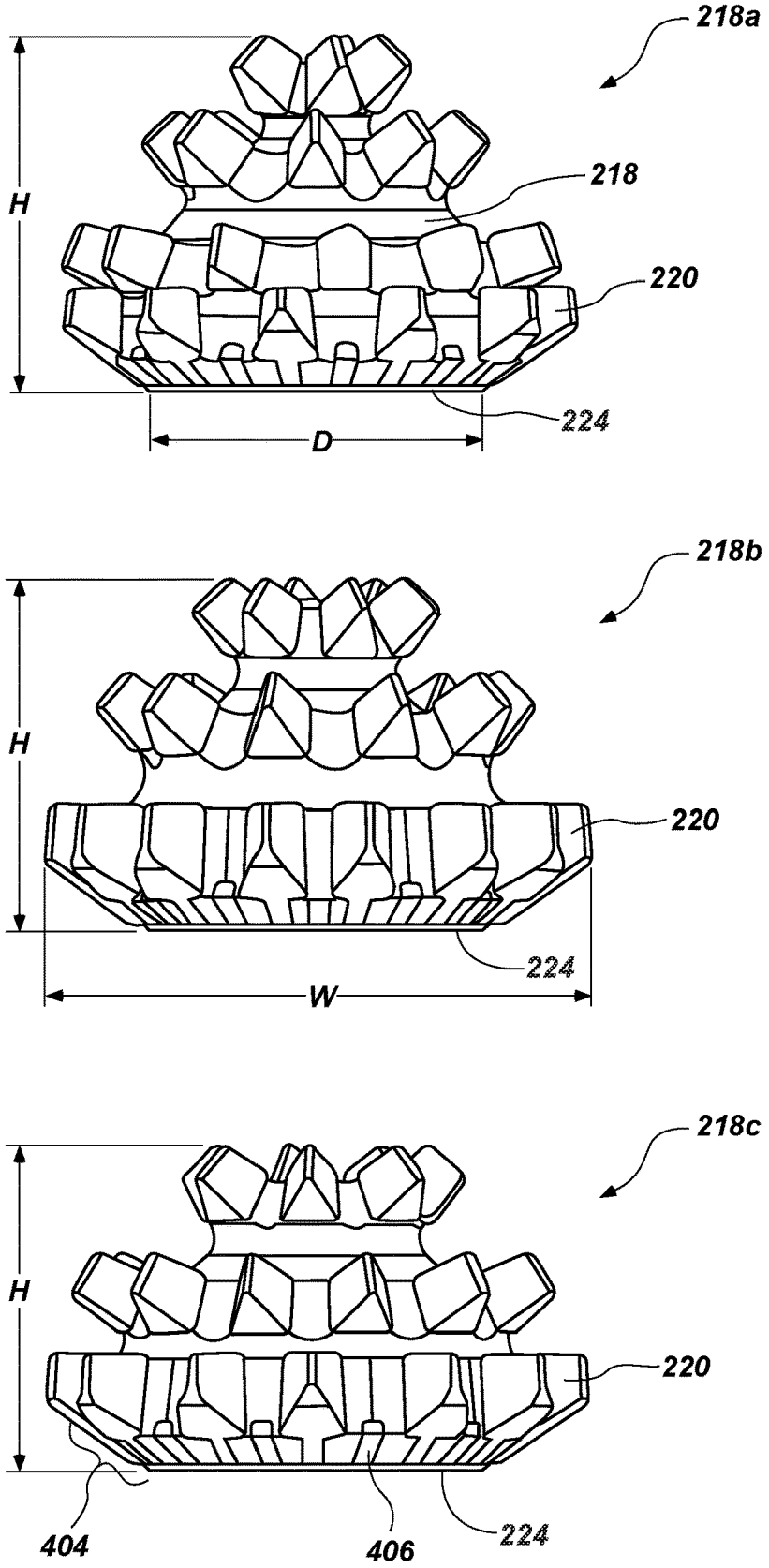
FIG. 4 is a side view of rotatable cutting structures of an earth-boring tool according to one or more embodiments of the present disclosure.

FIG. 4 is a side view of a first rotatable cutting structure 218*a*, a second rotatable cutting structure 218*b*, and a third rotatable cutting structure 218*c* of the earth-boring tool 200 according to one or more embodiments of the present disclosure. As mentioned above, the first, second, and third rotatable cutting structures 218*a*, 218*b*, 218*c* may have a plurality of cutting elements 220 formed and/or disposed thereon. Furthermore, the plurality of cutting elements 220 of each rotatable cutting structure 218*a*, 218*b*, 218*c* may be arranged in generally circumferential rows on an outer surface of the respective rotatable cutting structure 218*a*, 218*b*, 218*c*. Moreover, as noted above, the first, second, and third rotatable cutting structures 218*a*, 218*b*, 218*c*, may have a general truncated conical shape having the base end 224 (radially outermost end 224 when mounted to the earth-boring tool 200) and the opposite tapered end 226 (e.g., radially innermost end 226 when mounted to the earth-boring tool 200).

In one or more embodiments, the base end 224 of each of the first, second, and third rotatable cutting structures 218*a*, 218*b*, 218*c* may include a frusto-conical surface 404. Furthermore, the first, second, and third rotatable cutting structures 218*a*, 218*b*, 218*c* may include a plurality of impact inserts 406 disposed on the frusto-conical surface 404 (e.g., inserted into a portion of the rotatable cutting structure 218 defining the frusto-conical surface 404). In the example shown in FIG. 4, the cutting elements 220 and/or plurality of impact inserts 406 of the first, second, and third rotatable cutting structures 218*a*, 218*b*, 218*c* may be built up from hardfacing materials. Furthermore, as noted above, the first, second, and third rotatable cutting structures 218*a*, 218*b*, 218*c* may include tungsten carbide insert ("TCI") cutting structures or steel tooth cutting structures.

Furthermore, in some embodiments, the first, second, and third rotatable cutting structures 218*a*, 218*b*, and 218*c* may have varying heights H along the rotational axes 228*a*, 228*b*, 228*c* of the first, second, and third rotatable cutting structures 218*a*, 218*b*, 218*c*. In some embodiments, each of the first, second, and third rotatable cutting structures 218*a*, 218*b*, 218*c* may have a height H within a range extending from about 3.6 inches to about 12.7 inches depending on an outer diameter of the earth-boring tool 200. As a non-limiting example, an earth-boring tool 200 having an outer diameter of 26.0 inches may have a rotatable cutting structure 218 having a height of about 7.90 inches, 7.44 inches, or about 6.94 inches. In some embodiments, a ratio of each of the rotatable cutting structure's height and the outer diameter of the earth-boring tool 200 may be within a range extending from about 0.20 to about 0.35. For example, the ratio of each of the rotatable cutting structure's height and the outer diameter of the earth-boring tool 200 may be within a range extending from about 0.25 to about 0.30.

Furthermore, all of the rotatable cutting structures 218*a*, 218*b*, 218*c* may have a width W (e.g., outer diameter) within a range extending from about 5.5 inches to about 19.0 inches depending on the outer diameter of the earth-boring tool 200. As a non-limiting example, an earth-boring tool 200 having an outer diameter of 26.0 inches may have a rotatable cutting structure 218 having a width W of about 11.65 inches. For example, in one or more embodiments, a ratio of the width of each of the rotatable cutting structures 218*a*, 218*b*, 218*c* and the outer diameter of the earth-boring tool 200 may be within a range extending from about 0.40 to about 0.50. For instance, the ratio of the width of each of the rotatable cutting structures 218*a*, 218*b*, 218*c* and the outer diameter of the earth-boring tool 200 may be about 0.448.

Additionally, the base end 224 of both of the first, second, and third rotatable cutting structures 218*a*, 218*b*, 218*c* may have a diameter D within a range extending from about 3.5 inches to about 12.0 inches. As a non-limiting example, for an earth-boring tool 200 having a 26.0 inch outer diameter, the base end 224 of the first, second, and third rotatable cutting structures 218*a*, 218*b*, 218*c* may have a diameter D may have a diameter of about 7.09 inches. For instance, a ratio of a diameter D of the base end 224 of the rotatable cutting structures 218*a*, 218*b*, 218*c* and the outer diameter of the earth-boring tool 200 may be within a range extending from about 0.22 to about 0.30. For example, the ratio of the diameter D of the base end 224 of the rotatable cutting structures 218*a*, 218*b*, 218*c* and the outer diameter of the earth-boring tool 200 may be about 0.27.

FIG. 5 shows a schematic view of an overall cutting profile 500 defined by plurality of blades 214 and the rotatable cutting structures 218 of an earth-boring tool 200 (e.g., earth-boring tool 200) according to one or more embodiments of the present disclosure. The overall cutting profile 500 of the earth-boring tool 200 may be defined by the first cutting profile 502 defined by the plurality of blades 214 and the second cutting profile 504 defined by the rotatable cutting structures 218 of the earth-boring tool 200.

In some embodiments, the first cutting profile 502 and the second cutting profile 504 may overlap with each other in a radial direction. In some embodiments, the first cutting profile 502 overlaps with the second cutting profile 504 in a radial direction in an amount that is less than 20% of the outer diameter of the earth-boring tool 200. In additional embodiments, the first cutting profile 502 overlaps with the second cutting profile 504 in a radial direction in an amount that is less than 10% of the outer diameter of the earth-boring tool 200. In yet further embodiments, the first cutting profile 502 overlaps with the second cutting profile 504 in a radial direction in an amount that is less than 5% of the outer diameter of the earth-boring tool 200. In other embodiments, the first cutting profile 502 and the second cutting profile 504 may not overlap but may meet.

In some embodiments, the first cutting profile 502 may form between about 15% and about 65% of the overall cutting profile 500 of the earth-boring tool 200 along a radial direction. In additional embodiments, the first cutting profile 502 may form between about 25% and about 50% of the overall cutting profile 500 of the earth-boring tool 200 along a radial direction.

In one or more embodiments, the first cutting profile 502 defined by the plurality of blades 214 may be recessed relative to the second cutting profile 504 defined by the rotatable cutting structures 218 of the earth-boring tool 200. For example, the first cutting profile 502 may be recessed relative to the second cutting profile 504 in an axial direction of the earth-boring tool 200. In some embodiments, the first cutting profile 502 may be recessed relative to the second cutting profile 504 by about one cutting element or tooth width. In additional embodiments, the first cutting profile 502 may be recessed relative to the second cutting profile 504 by about one-half cutting element or tooth width. For example, the first cutting profile 502 may be recessed relative to the second cutting profile 504 by between about 0.25 inch and about 2.00 inches.

In additional embodiments, the first cutting profile 502 defined by the plurality of blades 214 may protrude relative to the second cutting profile 504 defined by the rotatable cutting structures 218 of the earth-boring tool 200. For example, the first cutting profile 502 may protrude relative to the second cutting profile 504 in an axial direction of the earth-boring tool 200. In some embodiments, the first cutting profile 502 may protrude relative to the second cutting profile 504 by about one cutting element or tooth width. In additional embodiments, the first cutting profile 502 may protrude relative to the second cutting profile 504 by about one half cutting element or tooth width. For example, the first cutting profile 502 may be recessed relative to the second cutting profile 504 by between about 0.25 inch and about 2.00 inches. In yet further embodiments, the first cutting profile 502 and the second cutting profile 504 may be aligned such that neither is recessed relative to the other and neither protrudes relative to the other. In view of the foregoing, having either the first or second cutting profiles 502, 504 be recessed relative to the either may reduce stick slip and may reduce torque on the plurality of blades 214 (when the blades 214 are recessed relative to the rotatable cutting structures 218).

Figure 6:
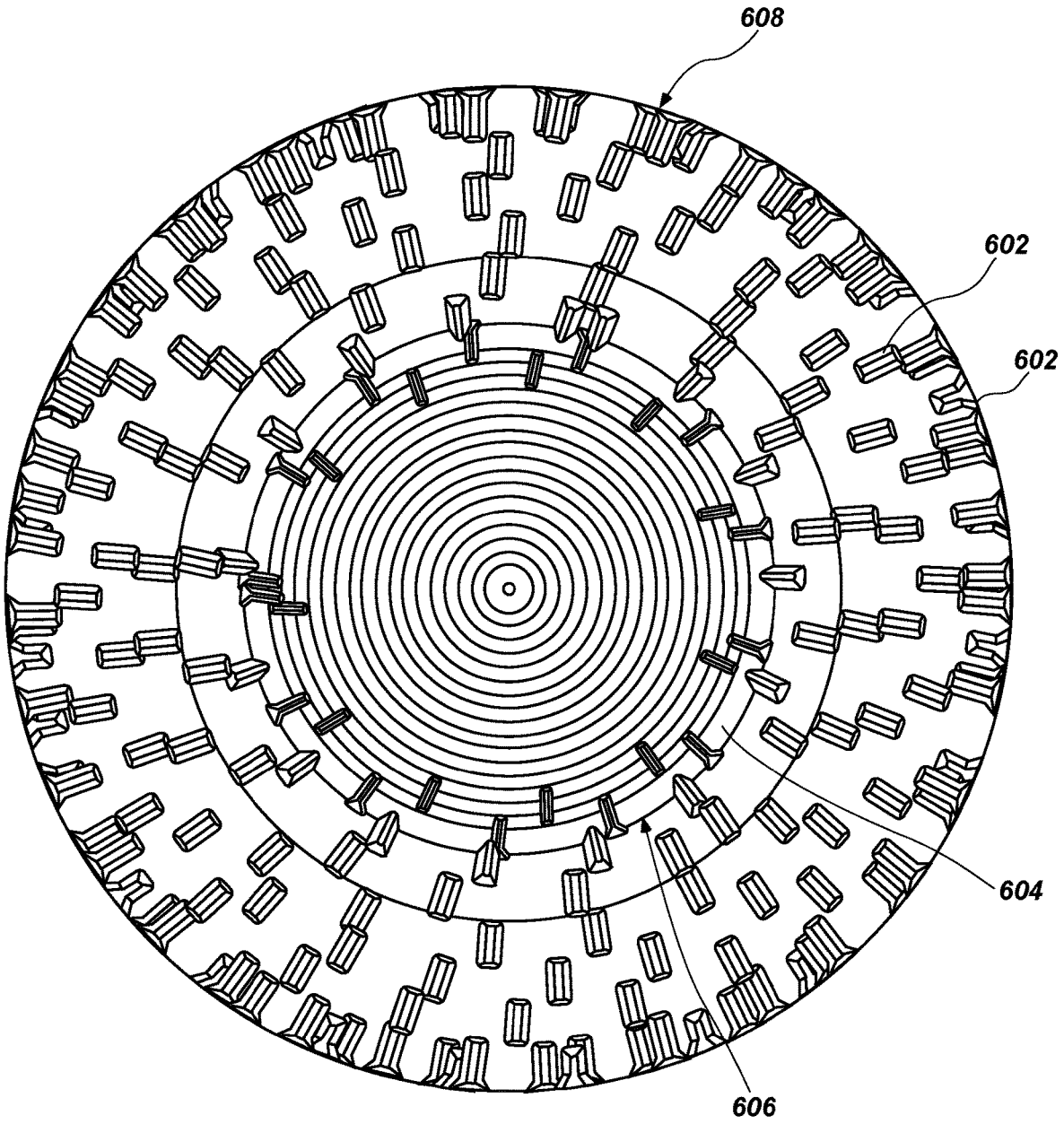
FIG. 6 is a schematic representation of contact locations where cutting elements of an earth-boring tool contact a formation during a rotation of the earth-boring tool according to one or more embodiments of the present disclosure.

FIG. 6 shows a schematic representation of contact locations 602 where cutting elements 220 (FIGS. 2 and 3) of the rotatable cutting structures 218 (first and second rotatable cutting structures 218*a*, 218*b*) of an earth-boring tool 200 may contact a formation 118 (FIG. 1) during a single rotation of the earth-boring tool 200 (FIG. 3) and contact locations 604 wherein cutting elements 230 of the plurality of blades 214 of the earth-boring tool 200 may contact the formation during a single rotation of the earth-boring tool 200.

As is shown in FIG. 6, a diameter of a first circle 606 defined by the contact locations 604 of the plurality of blades 214 of the earth-boring tool 200 may be between about 25% and about 50% of a diameter of a second circle 608 defined by the contact locations 602 of the rotatable cutting structures 218 of the earth-boring tool 200. As will be appreciated by one of ordinary skill in the art, having fixed blades extend out less than a full diameter of the earth-boring tool 200 reduces heat generated on the plurality of blades 214 and associated cutting elements 220. The foregoing reduces wear on the plurality of blades 214 and cutting elements 220. Moreover, reducing how much the plurality of blades 214 extend outward from the center longitudinal axis 205 of the earth-boring tool reduces the risk of stick-slip.

Referring to FIGS. 2-6 together, the earth-boring tool 200 of the present disclosure may provide advantages over conventional earth-boring tools. For example, in comparison to conventional roller cone bits, the earth-boring tool 200 may enable more aggressive drilling procedures due to larger rotatable cutting structure sizes. Moreover, the earth-boring tool 200 of the present disclosure may exhibit a reduced torque response in comparison to conventional hybrid bits. For instance, the torque response of the earth-boring tool 200 of the present disclosure may be similar to a torque response of roller cone bits. Additionally, the earth-boring tool 200 of the present disclosure may cost less to produce in comparison to conventional hybrid bits. Likewise, the earth-boring tool 200 of the present disclosure may provide better hole cleaning in comparison to conventional hybrid bits.

Figure 7:
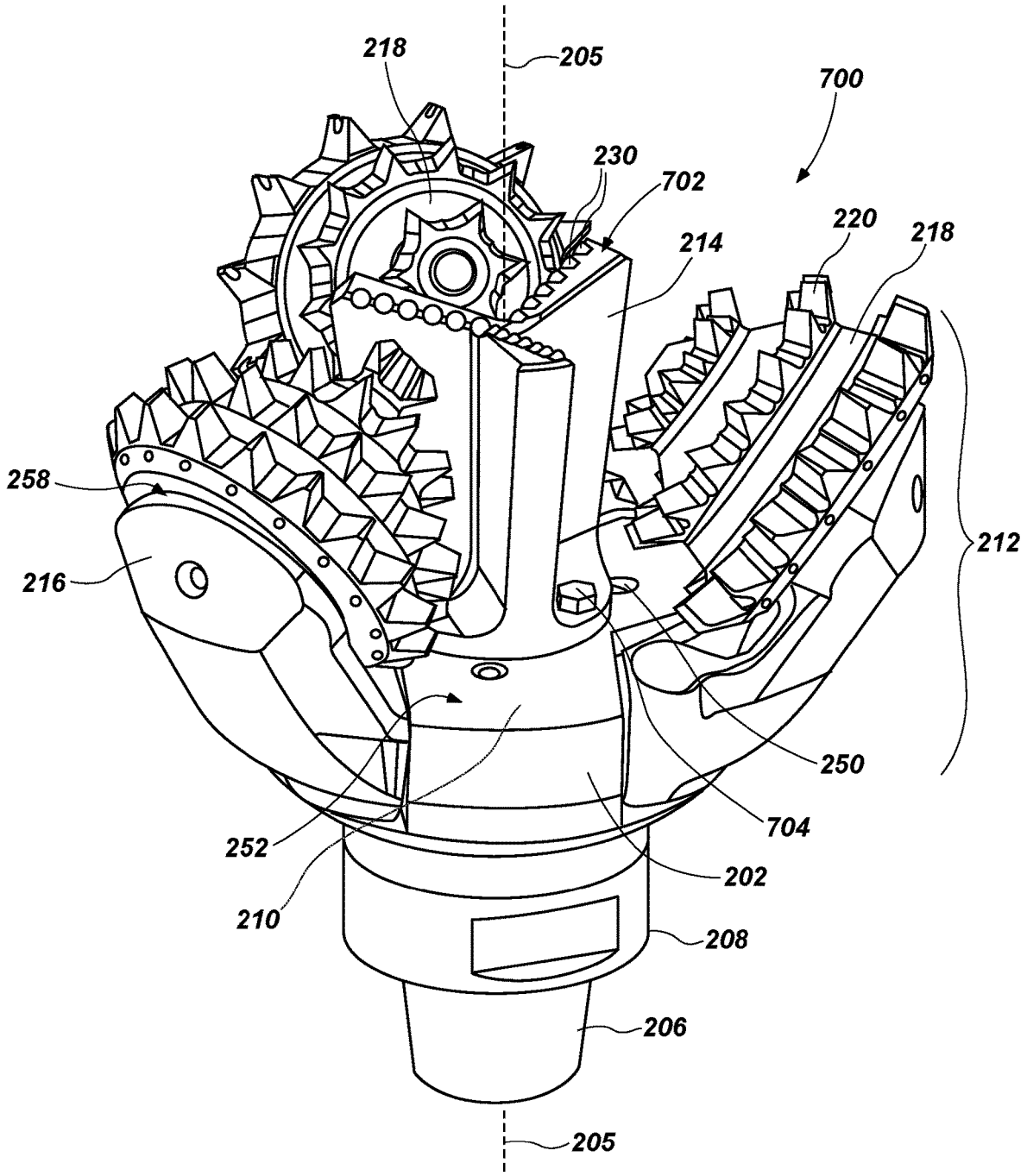
FIG. 7 is a perspective view of an earth-boring tool according to one or more additional embodiments of the present disclosure.

FIG. 7 is a perspective view of an earth-boring tool 700 according to one or more additional embodiments of the present disclosure. In particular, as shown in FIG. 7, in some embodiments, the plurality of blades 214 may form part of a single blade structure 702. Furthermore, the single blade structure 702 may be secured to the body 202 of the earth-boring tool 700 via one or more fasteners 704 (e.g., bolts, screws, etc.).

The blade structure 702 as described above may provide advantages over conventional earth-boring tools. For example, the blade structure 702 may allow for easy removal, repair, and/or replacement of the plurality of blades 214. Furthermore, the blade structure 702 may reduce time needed to remove, repair, and/or replace the plurality of blades 214. As will be understood by one of ordinary skill in the art, the foregoing advantages may reduce repair costs, may increase productivity, and may increase a life span of earth-boring tools.

Figure 8:
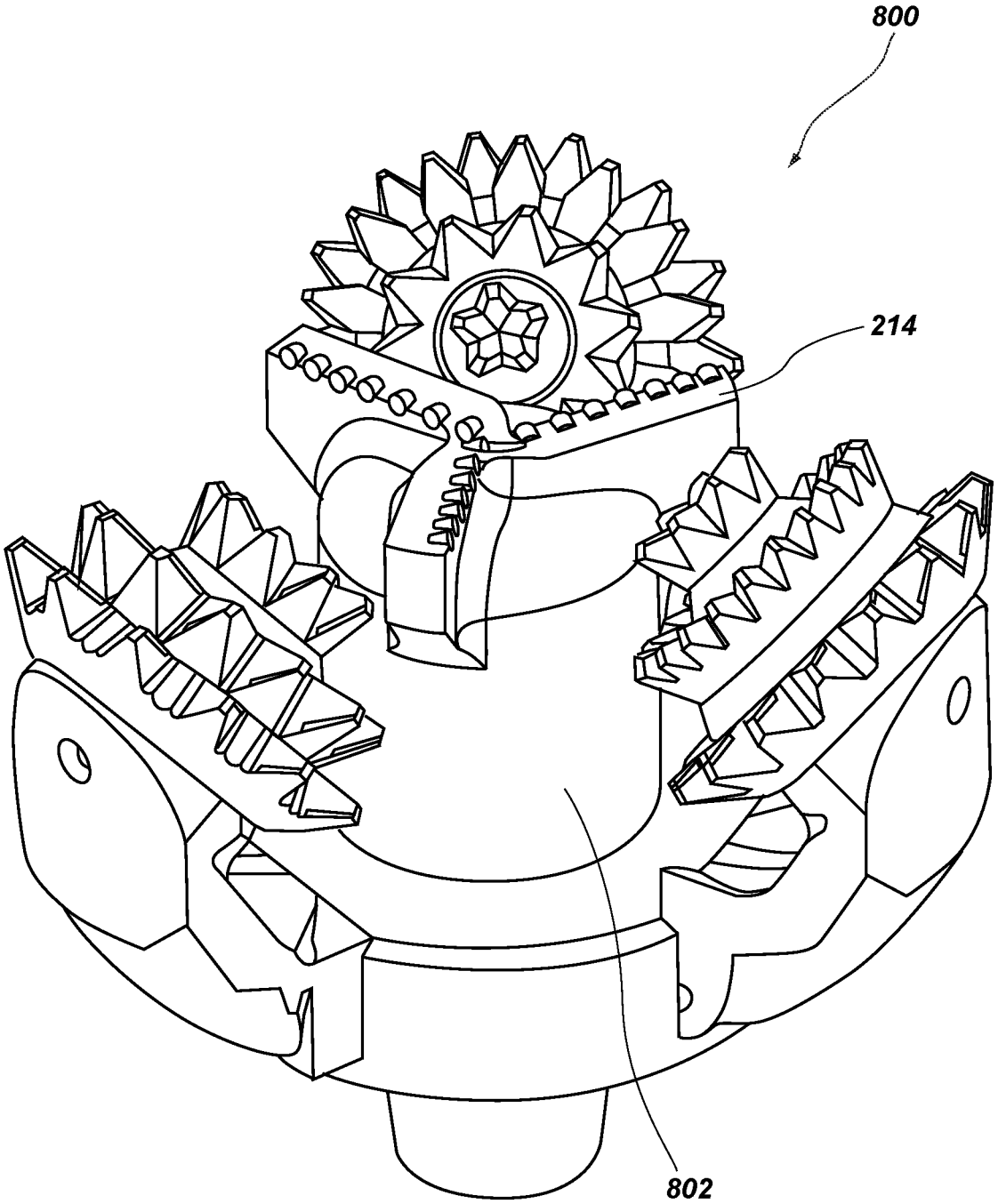
FIG. 8 is a perspective view of an earth-boring tool according to one or more additional embodiments of the present disclosure.

FIG. 8 is a perspective view of an earth-boring tool 800 according to one or more additional embodiments of the present disclosure. As shown in FIG. 8, in one or more embodiments, the plurality of blades 214 may be integral to the body 202 of the earth-boring tool 800. Furthermore, the plurality of blades 214 may extend radially outward from a center member 802 (e.g., post) proximate a distal end of the center member 802. The embodiment of FIG. 8 may enable hydraulic fluids to be disposed closer to a cutting face in comparison to conventional earth-boring tools.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. An earth-boring tool, comprising:

a body comprising a plurality of key receiving apertures, each key receiving aperture extending substantially radially outward from a center longitudinal axis of the earth-boring tool;

a plurality of blade structures, each blade structure extending axially from the body and extending radially outward from a center longitudinal axis of the earth-boring tool to less than an outer diameter of the earth-boring tool, each of the plurality of blade structures being distinct from the other blade structures and comprising:

a plurality of cutting elements disposed thereon and defining a first cutting profile; and a key member for mating with a respective key receiving aperture of the plurality of key receiving apertures of the body; and at least one rotatable cutting structure assembly coupled to the body and comprising:

a leg extending axially from the body; and a rotatable cutting structure rotatably coupled to the leg, the rotatable cutting structure defining a second cutting profile extending to the outer diameter of the earth-boring tool, wherein the first cutting profile overlaps with the second cutting profile in a radial direction in an amount that is 20% or less of the outer diameter of the earth-boring tool.

2. The earth-boring tool of claim 1, wherein the leg of the at least one rotatable cutting structure asssembly defines a mounting surface upon which the rotatable cutting structure is mounted, and wherein the mounting surface at least generally faces the center longitudinal axis of the earth-boring tool.

3. The earth-boring tool of claim 1, wherein each blade structure of the plurality of blade structures extends radially outward from the center longitudinal axis of the earth-boring tool a distance that is between about 12.5% and about 25% of an overall diameter of the earth-boring tool.

4. The earth-boring tool of claim 1, wherein the first cutting profile of the plurality of cutting elements of the plurality of blade structures is recessed axially relative to the second cutting profile of the rotatable cutting structure.

5. The earth-boring tool of claim 1, wherein the first cutting profile of the plurality of cutting elements of the plurality of blade structures protrudes axially relative to the second cutting profile of the rotatable cutting structure.

6. The earth-boring tool of claim 1, wherein the plurality of blade structures comprises at least three blade structures.

7. The earth-boring tool of claim 6, wherein the at least one rotatable cutting structure assembly comprises at least three rotatable cutting structure assemblies, and wherein each rotatable cutting structure of the at least three rotatable cutting structure assemblies is disposed between adjacent blade structures of the at least three blade structures.

8. An earth-boring tool, comprising:

a body;

a blade structure comprising a plurality of blades extending axially from the body and each blade extending radially outward from proximate a center longitudinal axis of the earth-boring tool to less than an outer diameter of the earth-boring tool, the plurality of blades having a plurality of cutting elements defining a first cutting profile; and a plurality of rotatable cutting structure assemblies coupled to the body, each rotatable cutting structure assembly comprising:

a leg extending axially from the body; and a rotatable cutting structure rotatably coupled to the leg, wherein the rotatable cutting structures of the plurality of rotatable cutting structure assemblies define a second cutting profile extending to the outer diameter of the earth-boring tool, wherein the first cutting profile of the plurality of blades protrudes axially relative to the second cutting profile of the plurality of rotatable cutting structures, and wherein the first cutting profile overlaps with the second cutting profile in a radial direction in an amount that is 20% or less of the outer diameter of the earth-boring tool.

9. The earth-boring tool of claim 8, wherein a ratio of an outer diameter of each rotatable cutting structure of the plurality of rotatable cutting structure assemblies and the outer diameter of the earth-boring tool is within a range extending from about 0.40 to about 0.50.

10. The earth-boring tool of claim 8, wherein the leg of each rotatable cutting structure assembly is separably attached to the body of the earth-boring tool.

11. The earth-boring tool of claim 8, wherein the leg of each rotatable cutting structure assembly extends radially outward in addition to axially from the body of the earth-boring tool.

12. The earth-boring tool of claim 8, wherein a ratio of a linear offset of each rotatable cutting structure plurality of rotatable cutting structure assemblies and the outer diameter of the earth-boring tool is within a range extending from about 0.024 to about 0.028.

13. The earth-boring tool of claim 8, wherein the body comprises a key receiving aperture extending axially into the body, and wherein the blade structure comprises a key member sized and shaped to be insertable into the key receiving aperture of the body.

14. The earth-boring tool of claim 8, wherein the blade structure and the body are portions of an integral, unitary body.

15. The earth-boring tool of claim 8, wherein the blade structure is separate and distinct from the body and is coupled to the body via one or more fasteners or welds.

16. A method of forming an earth-boring tool, comprising:

forming a body comprising a plurality of key receiving apertures, each key receiving aperture extending substantially radially outward from a center longitudinal axis of the earth-boring tool;

forming a plurality of blade structures, each blade structure extending axially from the body and extending radially outward from a center longitudinal axis of the earth-boring tool to less than an outer diameter of the earth-boring tool, each of the plurality of blade structures being distinct from the other blade structures and comprising:

a plurality of cutting elements defining a first cutting profile; and a key member for mating with a respective key receiving aperture of the plurality of key receiving apertures of the body; and coupling at least one rotatable cutting structure assembly to the body, the at least one rotatable cutting structure assembly comprising:

a leg extending axially from the body; and a rotatable cutting structure rotatably coupled to the leg, the rotatable cutting structure defining a second cutting profile extending to the outer diameter of the earth-boring tool, wherein coupling the at least one rotatable cutting structure assembly to the body comprises, coupling the rotatable cutting structure rotatably to the leg such that the first cutting profile overlaps with the second cutting profile in a radial direction in an amount that is 20% or less of the outer diameter of the earth-boring tool.

17. The method of claim 16, wherein forming a body having at least one blade comprises forming the at least one blade to extend radially outward from the center longitudinal axis of the earth-boring tool such that a ratio of a radial length of the at least one blade and the outer diameter of the earth-boring tool is between about 0.125 and about 0.25.

18. The method of claim 16, further comprising causing at least one of the first cutting profile and the second cutting profile to be recessed axially relative to the other.

* * * * *